US012171351B2

(12) United States Patent
Doig et al.

(10) Patent No.: US 12,171,351 B2
(45) Date of Patent: Dec. 24, 2024

(54) SYSTEMS AND METHODS RELATED TO FLUID CONTAINER MOUNTING AND SUPPORT

(71) Applicant: Superior Innovations Group, LLC, West Bend, WI (US)

(72) Inventors: Thomas S. Doig, West Bend, WI (US); Lucas J. Johnson, Cadott, WI (US); Jordan M. Loeck, Neenah, WI (US); David J. Gruenwald, Menasha, WI (US)

( * ) Notice: Subject to any disclaimer, the term of this patent is extended or adjusted under 35 U.S.C. 154(b) by 649 days.

(21) Appl. No.: 17/429,377

(22) PCT Filed: Feb. 7, 2020

(86) PCT No.: PCT/US2020/017168
§ 371 (c)(1),
(2) Date: Aug. 9, 2021

(87) PCT Pub. No.: WO2020/163688
PCT Pub. Date: Aug. 13, 2020

(65) Prior Publication Data

US 2022/0110468 A1 Apr. 14, 2022

Related U.S. Application Data

(60) Provisional application No. 62/918,640, filed on Feb. 8, 2019.

(51) Int. Cl.
*A47G 23/02* (2006.01)

(52) U.S. Cl.
CPC ..... *A47G 23/0216* (2013.01)

(58) Field of Classification Search
CPC ..... A47G 23/0216; A47G 23/0266; A47J 45/077; A45F 2005/1006; A45F 2200/0583
USPC ..... 294/31.2, 32; 220/742; 248/311.2
See application file for complete search history.

(56) References Cited

U.S. PATENT DOCUMENTS 1,288,839 A 12/1918 Conrad
2,325,841 A * 8/1943 Faber ..... A47J 45/077 99/428
2,602,687 A * 7/1952 Stanley ..... B65D 23/108 294/31.2
2,926,879 A * 3/1960 Dietrich ..... B63B 29/12 224/406
2,942,828 A * 6/1960 Kondrat ..... A47G 23/0258 248/145.6
4,395,013 A 7/1983 Wissinger
(Continued)

OTHER PUBLICATIONS

BiKASE, ABC Cage—Any Bottle Cage, Product advertised at https://bikase.com/product/abc-cage/, Date unknown.
(Continued)

*Primary Examiner* — Dean J Kramer
(74) *Attorney, Agent, or Firm* — Smith Keane LLP

(57) ABSTRACT

Systems and methods directed to container support and/or retention include a ring coupled to a handle, the ring defining a container through-hole. The ring is rotatably coupled to the handle and/or the ring is adjustable in its effective diameter. Mounting structure in the form of a cooperative and mating rail and slot combination is provided to secure the handle to a receiver, the receiver being secured to a substrate.

12 Claims, 6 Drawing Sheets

(56) References Cited

U.S. PATENT DOCUMENTS

| | | | | |
|---|---|---|---|---|
| 4,767,092 | A | 8/1988 | Weatherly | |
| 4,828,211 | A | 5/1989 | McConnel et al. | |
| 4,834,438 | A * | 5/1989 | Haidet | A47G 23/0241 294/169 |
| 4,887,784 | A | 12/1989 | Kayali | |
| 4,951,191 | A | 8/1990 | Hiroi et al. | |
| 5,054,733 | A | 10/1991 | Shields | |
| 5,071,100 | A | 12/1991 | Sweeny | |
| 5,072,909 | A | 12/1991 | Huang | |
| 5,149,032 | A | 9/1992 | Jones et al. | |
| 5,219,140 | A | 6/1993 | Spykerman | |
| 5,335,954 | A * | 8/1994 | Holub | A45F 5/10 215/396 |
| 5,385,325 | A | 1/1995 | Rigsby | |
| 5,390,887 | A | 2/1995 | Campbell | |
| 5,445,350 | A | 8/1995 | Rigsby | |
| 5,505,417 | A | 4/1996 | Plocher | |
| 5,791,618 | A | 8/1998 | Lancaster | |
| 5,833,319 | A | 11/1998 | Davis | |
| 5,931,431 | A | 8/1999 | Stinnett | |
| 5,996,957 | A * | 12/1999 | Kurtz | A47G 23/0225 248/231.21 |
| 6,070,844 | A | 6/2000 | Salenbauch et al. | |
| 6,250,592 | B1 | 6/2001 | Davis | |
| 7,090,183 | B2 | 8/2006 | Heybl et al. | |
| 7,284,777 | B1 * | 10/2007 | Kraemer | B65G 7/12 294/165 |
| 7,581,770 | B2 * | 9/2009 | Jones | A47J 45/078 220/758 |
| 8,066,148 | B2 | 11/2011 | Garahan | |
| 8,757,573 | B1 | 6/2014 | Barnes, Jr. | |
| 9,428,313 | B2 | 8/2016 | Olsen | |
| 2004/0112930 | A1 | 6/2004 | Beglau | |
| 2010/0096396 | A1 * | 4/2010 | Doig | B60N 3/106 220/737 |
| 2014/0091586 | A1 | 4/2014 | Brandon | |
| 2015/0164256 | A1 | 6/2015 | Helton | |
| 2015/0298496 | A1 * | 10/2015 | Payne | B44D 3/14 220/696 |
| 2020/0002006 | A1 | 1/2020 | Slack, Jr. | |

OTHER PUBLICATIONS

Arundel Bicycle Company, Bando, Product advertised at https://www.arundelbike.com/product/bando/, Date unknown.

Arundel Bicycle Company, Looney Bin, Product advertised at https://www.arundelbike.com/product/looney-bin/, Date unknown.

Pedego Electric Bikes, Looney Bin Adjustable Drink Holder, Product advertised at https://pedegoelectricbikes.com/product/looney-bin-adjustable-drink-holder/, Date unknown.

* cited by examiner

SYSTEMS AND METHODS RELATED TO FLUID CONTAINER MOUNTING AND SUPPORT

RELATED APPLICATIONS

This application claims the benefit of U.S. Provisional Patent Application Ser. No. 62/918,640, filed 8 Feb. 2019, and entitled "Universal Beverage Holder/Mount," which is incorporated herein by reference in its entirety.

BACKGROUND OF THE INVENTION

The present invention relates generally to devices for receiving and supporting containers, and more particularly to beverage container mounts.

Beverage containers are available in dozens of different shapes and sizes. While some are smaller and some are larger, typical sizes range from a 12-ounce soda or beer can that is approximately 2⅝-inch diameter up to trending 30-ounce tumblers that are approximately 4 inches in diameter. Most beverage containers are generally cylindrical with some being tapered and having a larger diameter top and a smaller diameter bottom although some tapered beverage containers have a smaller diameter top and larger diameter bottom. Other containers, such as soda or beer cans or bottles, for example, are typically substantially cylindrical in shape along a majority of their length and are therefore non-tapered. The height of beverage containers varies greatly with a typical 12-ounce beer or soda can at about 4⅝ inches tall up to some water bottles and other such beverage containers that may meet or exceed 12 inches in height.

For the purpose of this application, we will refer to beverage containers that have handles as mugs. Typically, cylindrical in design, a mug may be short, tall or anything in between and may be tapered, non-tapered or somewhat barrel shaped whereby they may have a small top and bottom diameter with a larger middle diameter.

A variety of manufacturers make portable handles that one may affix to a specific beverage container so as to essentially turn their non-handled beverage container into a mug or, said another way, a beverage container with a handle. Typically, these handles are designed to fit a specific beverage container. For example, the 30-ounce tumblers, discussed above, are all approximately the same size and shape therefore it is possible to purchase a manufacturers' handle that will fit, or somewhat fit, a different manufacturers' 30-ounce tumbler. Similar to the 30-ounce tumblers, several manufacturers make a variety of other tumblers that have size and shape similarities to each other. For example, several manufacturers make a 20-ounce tumbler, many of which are similar to each other is size and shape. Should one purchase a 20-ounce tumbler handle from one manufacturer, chances are that handle may fit, or somewhat fit, another manufacturers 20-ounce tumbler.

The potential challenge with the above mix and match scenario is that the handles and tumblers from different manufacturers don't always fit correctly and in some cases, they don't fit at all. One scenario may be that the handle fits the tumbler but the handle ring that the tumbler fits into is either too high up on the tumbler or perhaps too low down on the tumbler which, in either case, makes for a "fit" that is just not perfectly acceptable to the user.

Although certain size tumblers have been introduced herein, there are obviously a variety of other sizes of tumblers on the market as well as a variety of different sizes and shapes of beverage containers, as discussed earlier.

Furthermore, should one want a handle for a variety of different, non-handled beverage containers, it is quite possible that they may need to purchase a different handle for each beverage container and in some cases, suitable handles may simply not be available for a given container.

Prior tumbler handles, in addition to being dedicated to one size of tumbler (20 or 30 ounces, for example) are most often designed to hold and secure a tapered beverage container which is the design of many prior tumblers. For the purpose of this application, a tapered beverage container is one whereby the top diameter of the beverage container is larger than the bottom diameter of the beverage container therefore the beverage container is tapered radially inwardly from top to bottom although, and as stated earlier, some tapered beverage containers have a smaller top diameter and larger bottom diameter (outwardly tapered). This taper is often slight. For example, a tapered beverage container may have a top diameter of about 4 inches and a bottom diameter of about 3.5 inches. Should one wish to hold a non-tapered beverage container, such as a typical cylindrical beer or soda can, with a typical tumbler handle, it is probable that the beverage container will either be too large in diameter such that it won't fit into the ring of the handle or the beverage container will be too small in diameter such that it will fall straight through the ring of the handle. In either case, typical prior tumbler handles are not suited for holding non-tapered beverage containers.

Prior tumbler handles are often constructed out of some sort of plastic resin and often plastic injection molded in one piece whereby they contain a handle and a ring which contains and holds the beverage container, when in use. As the vertical handle is roughly perpendicular to the horizontal ring, the device itself is somewhat bulky and may therefore be somewhat space-consuming should one wish to store their handle in their purse, pocket or glovebox, for example, when not in use. Prior tumbler handles are typically designed and meant to be held onto by the user. When not in use, the beverage container, with attached handle, may be set down or possibly set into a beverage holder such as a drink holder in an automobile, provided the handle is positioned such, on or around the beverage container, so as to allow the beverage container (and attached handle) to be effectively placed in the drink holder without the handle impeding the ability for the beverage container to be placed effectively into the drink holder.

One may choose to place their beverage container in a static beverage holder such as the beverage holders in a car, for example. In this example, one may choose to place their beverage container in a static beverage holder so as to secure the beverage container when they are not holding it or drinking from it. Cars are just one example of a vehicle that may be equipped with static beverage holders. Lawnmowers, tractors, golf carts, strollers, boats, motorcycles, ATV's/UTV's, RV's, and bicycles are just a few other examples of mobile vehicles that may utilize or incorporate static beverage holders. This style of beverage holder includes a variety of different designs but often includes a cylindrical "bucket" that may be 2-3 inches in diameter and perhaps 1-3 inches deep, for example, thereby offering the user a static "bucket" to set their beverage container into when not in use. Many of this style of beverage holder contains mechanical features such as expanding and retracting arms or rubber flaps, for example, that render the beverage holder able to perhaps accept a variety different sizes/diameters of beverage containers. This style of beverage container is often acceptable in low-dynamic applications such as the everyday use of an automobile but may not be effective in properly securing a beverage container should the automobile be subjected to high-dynamic forces such as when one accelerates or decelerates quickly, or is driving on bumpy roads or uneven ground or during sharp turns at high speed, for example.

Due to the relatively small diameter of beverage holders (i.e., cup holders) found in automobiles and many other vehicles, the beverage holders may not be large enough, therefore may be unsuitable for larger diameter beverage containers such as the "Big Gulp" coffee mugs, for example, found at many gas/convenience stations. While some of these large coffee-type containers are tapered and have a large diameter top portion of the container with a smaller diameter bottom portion of the container such that the bottom of the beverage container may fit into the "bucket", one may find that these containers are typically somewhat tall and may be top-heavy to the extent that they may be more prone to tipping over during even the slightest of dynamic movement of the vehicle such as rapid acceleration or deceleration as described above.

Travel on water with a beverage may be even more dubious. Due to the dynamic motion of a boat, due to waves, for example, one can assume that a beverage holder on a boat would need to be one that is substantially effective in holding and securing a beverage container such that the beverage container cannot tip over or otherwise fall out of the beverage holder as the boat is thrust up and down or back and forth, for example, due to waves, sharp turns or rapid acceleration or deceleration. Gimbled beverage holders are somewhat popular in boating as this design of beverage holder is one that allows the beverage holder (and beverage container) to essentially swivel back and forth and side to side as the boat is subjected to waves or other such forces that cause the boat to move up and down and/or back and forth. While gimbled beverage holders may be somewhat effective in some applications, they fall short in other applications. Gimbled beverage holders are typically one-size diameter although some may essentially have a ring that can expand and retract such that they may hold a variety of different diameter beverage containers. That said, even the ones that can hold a variety of different size containers are somewhat limited in the range or size of beverage containers that they can hold. Further, this style of beverage container is typically not well suited for tall beverage containers such as the tall water bottles, discussed earlier, that may reach or exceed twelve inches in height. Additionally, gimbled beverage holders do not typically fold up, therefore, when not in use, they may protrude out from their mounting surface and be "in the way". Further, the ring of a typical gimbled-style beverage holder is often larger in diameter than the beverage container that it is holding, therefore, the beverage container may jostle around inside of the ring as the boat, for example, is subjected to movement due to waves etc. as described earlier.

Popular on many boats are folding beverage holders. Typically mounted to a vertical surface down from the port and/or starboard gunwale on a boat, for example, the folding beverage holders may be folded up, when not in use, thereby rendering them "out of the way". Unfolding them, by folding the base down and the arms up, allows one to then place their beverage container in the holder. The quality of construction of folding beverage holders is all over the board with some units being constructed out of stainless steel and some out of cheap plastic and everything in between. Regardless of the material composition of the folding beverage holder, this design is often not effective in properly securing a beverage in a dynamic application, such as boating, as the arms, that supposedly wrap around and secure the beverage, are typically flimsily made and simply don't have the holding force to properly secure a beverage as the boat is moving back and forth, up and down or side to side due to wave action or the like. They are especially ineffective in holding large, tall and heavy beverage containers as they are simply not designed to prevent such containers from tipping over and/or falling out of the holder in a dynamic application such as boating. This would also be the case in other dynamic vehicle applications such as bicycles, motorcycles, lawn mowers, ATV's etc., but for the sake of this application, we will largely be discussed their application on boats.

In addition to the typical folding beverage holder being ineffective at properly securing a beverage in a dynamic application such as boating, the vast majority of folding beverage holders are constructed from cheap plastic and are very susceptible to breaking. Additionally, when new, the mechanical, folding arms and base may be somewhat effective in their motion and performance characteristics but rapidly decline due to the design itself and/or the cheap material(s) used in the construction of the beverage holder.

There are multiple manufacturers of said folding beverage holders, most of which include a four-hole mounting pattern that allows one to bolt, screw or otherwise affix their beverage holder to a substrate as discussed earlier. Unfortunately there is not a universal mounting-hole pattern that the manufactures adhere to, therefore, should you need to replace a broken or otherwise mal-functioning folding beverage holder on your boat, for example, and you purchase a different brand than the one you are replacing, the chances are that you may have to drill additional holes in your boat in order to mount the new folding beverage holder, resulting in one having multiple and unusable holes in their boat.

SUMMARY OF THE INVENTION

The present invention relates to a beverage holder that one may use to hold a number of different size and shape beverage containers by essentially creating a secure handle and cradle for such containers.

A device according to the present invention includes a handle having a longitudinal length and a ring configured to receive and support a fluid container in a direction that is closer to parallel to the handle longitudinal length than to orthogonal to the handle longitudinal length. The ring is at least one of (a) rotatably coupled to the handle and movable from a first static position to a second static position, the first static position being substantially parallel to the longitudinal length of the handle and the second static position being between the first static position and an angle of about 90 degrees from the first static position; and (b) adjustable in diameter.

According to an aspect of an embodiment of a device according to the present invention the ring is selectively rotatable about an axis extending along a direction that is perpendicular skew to the longitudinal length of the handle.

According to another aspect of an embodiment of a device according to the present invention, the ring comprises a strap coupled to a yoke. The yoke may comprise a pair of arms extending from a neck, each arm extending to a free end. The strap extends between two strap ends, each strap end being secured to one of the arm free ends, such as by being riveted thereto. The strap may be adjustable in length, such as by being continuously adjustable or adjustable to a plurality of fixed lengths, thereby changing an effective diameter of the ring. A preferred effective ring diameter (or container through-hole provided through the ring) is between 2.5 and 4.5 inches, more preferably being between 2.625 inches and 4 inches.

According to a further aspect of an embodiment of a device according to the present invention, if the ring is rotatably coupled to the handle and movable from a first static position to a second static position, the first static position being substantially parallel to the longitudinal length of the handle and the second static position being between the first static position and an angle of about 90 degrees from the first static position, the ring may include a neck extending into a portion of the handle. The neck may include a first ratchet surface, which is mateable with a second ratchet surface provided on the handle, such as in a gooseneck portion of the handle. A bias member (e.g., compression spring) may apply outward compressed force between the neck and the handle to force the first ratchet surface against the second ratchet surface.

According to yet another aspect of a device according to the present invention, a mounting slot may be formed along a rear side of the handle, the mounting slot extending from an open end to a terminus.

According to still another aspect of a device according to the present invention, a medial slot may be formed along a front surface of the handle. A support lever may extend along a lever length from a first end rotatably supported by the handle to a free end. The support lever is preferably rotatably coupled to the handle and movable from a first static position to a second static position, the first static position being substantially parallel to the longitudinal length of the handle and the second static position being between the first static position and an angle of about 90 degrees from the first static position, An embodiment of a method according to the present invention includes the steps of securing a mounting rail to a substrate, placing a fluid container within a ring, the ring being rotatably coupled to a handle, mating a portion of the handle with the mounting rail, the mounting rail supporting the handle; and rotating the ring with respect to the handle.

According to an aspect of a method according to the present invention, the method may also include the step of adjusting a diameter of the ring. Such adjustment is preferably capable of being performed with one (a single) human hand and may be a continuous adjustment or further include the step of moving portions of the ring through a plurality of discrete static positions.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
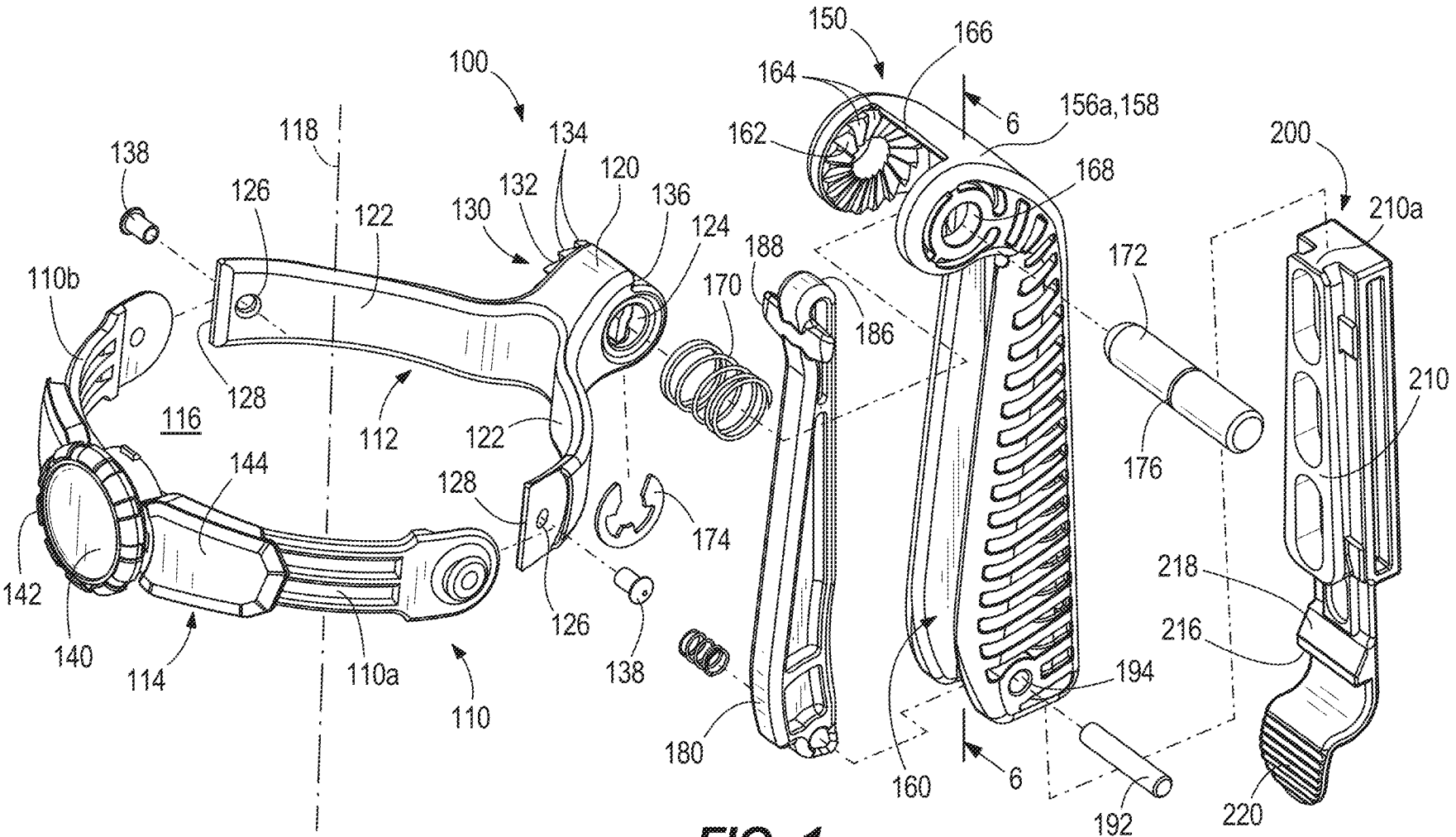
FIG. 1 is a perspective exploded assembly view of an embodiment of a container holder according to the present invention and an optional mounting clip.

FIG. 1 is an exploded assembly view of an embodiment 100 of fluid container holder according to the present invention and an optional mounting clip or receiver 200. The fluid container holder generally includes a receiving ring 110 coupled to a handle 150.

Although the receiving ring 110 may be formed from a relatively solid, unitary piece of material (e.g., injection-molded plastic providing a singular size ring), it is more preferable to provide an adjustable ring 110. The receiving ring 110 is preferably formed from a yoke 112 in cooperation with a strap 114 to define a container through-hole 116 about a container axis 118. The yoke 112 includes a neck 120 from which two arms 122 extend in opposite directions, along a concave curve, towards each other, generally forming a C-shape. Through the neck 120 is a bearing aperture 124 formed at least substantially perpendicular skew relative to the container axis 118. A strap mounting aperture 126 is formed through each arm 122, such as proximate a free end 128 of each arm 122. Preferably, on at least one side of the yoke neck 120, formed about or near the bearing aperture 124, is a registration or positioning mechanism 130, such as a first ratchet surface 132. The first ratchet surface 132 may have one tooth, but preferably has a plurality of teeth 134, configured to engage a second ratchet surface 162 provided on the handle 150, to be described in further detail below. Also provided, such as on the yoke neck 120, is a rotational limit surface 136, configured to contact a stop lip 166 on the handle 150 to impede rotation of the ring 110 relative to the handle 150 at a predetermined angle (e.g., approximately ninety degrees with respect to the longitudinal length 152 of the handle 150, as described below). The yoke 112 is preferably formed from a relatively sturdy material (e.g., injection molded plastic, cast aluminum, etc.) but in such dimensions to allow at least some flexing of the arms 122 for adaptation of the ring 110 to various size containers. Optionally, the yoke arms 122 may be provided with a partial or complete rubber overmold (not shown) to provide a resilient surface facing the container through-hole 116, which may aid in container retention. A preferred yoke 112, upon manufacture and in free state, preferably includes an open distance between the arm free ends 128 of about 2.75 inches to about 3.5 inches, with about 3.25 inches being more preferred.

Figure 2:
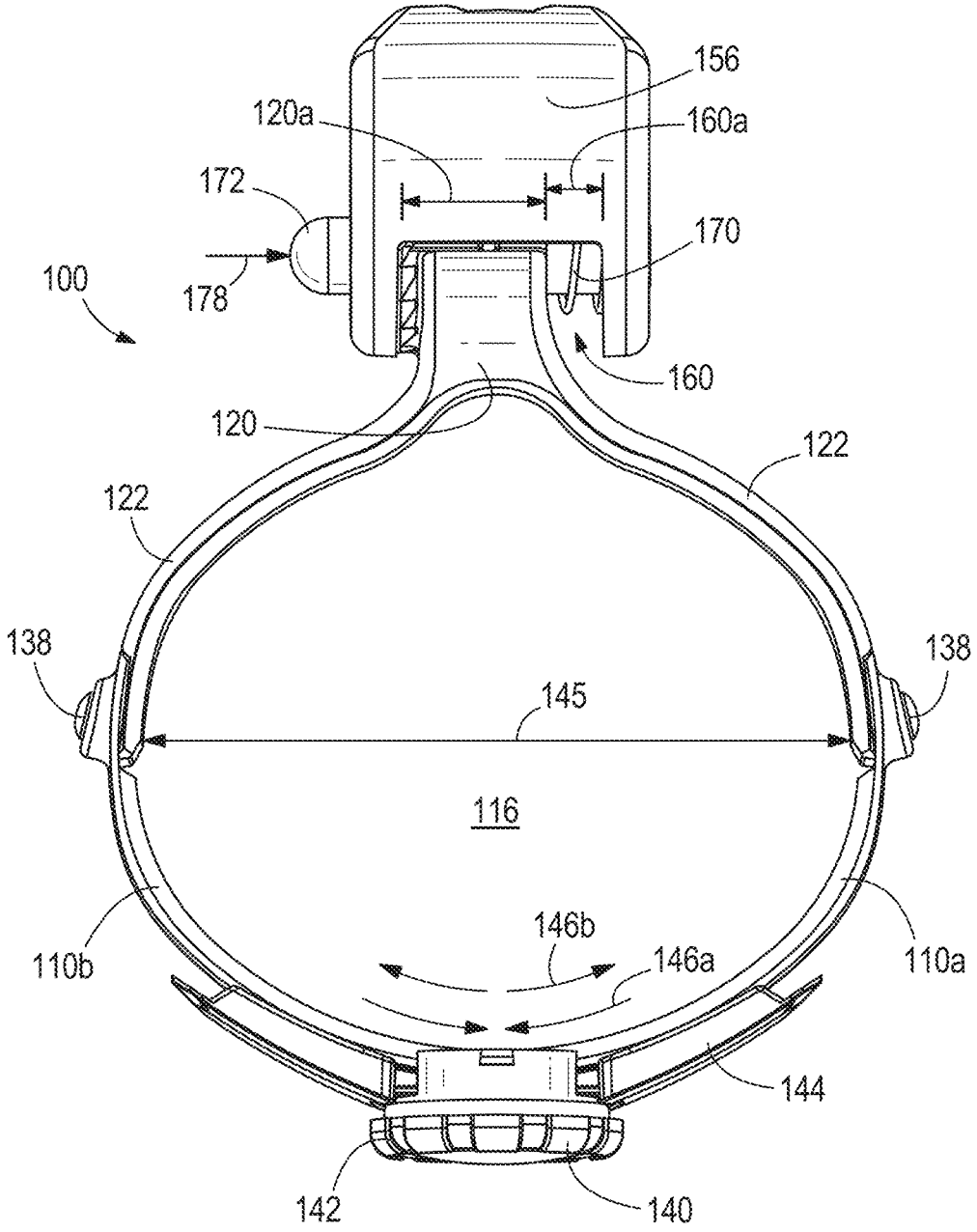
FIG. 2 is a top plan view of the container holder of FIG. 1.
Figure 3B:
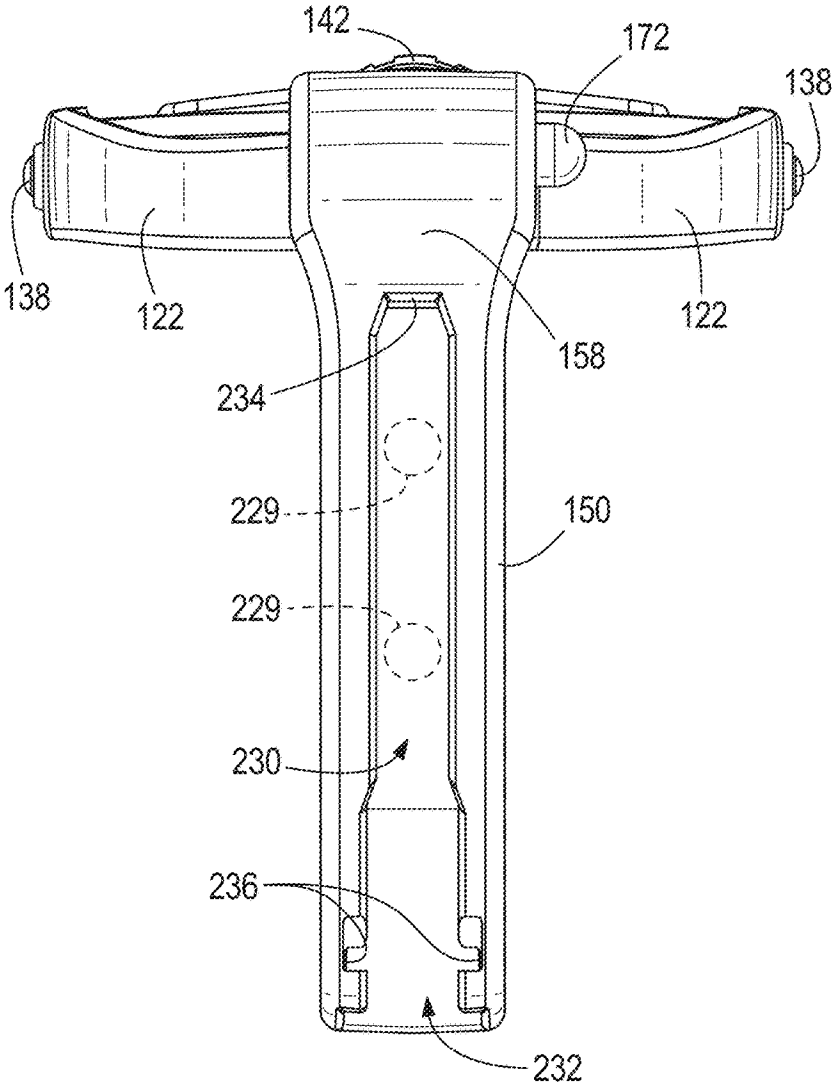
FIG. 3B is a rear elevation view of the container holder of FIG. 1.
Figure 3A:
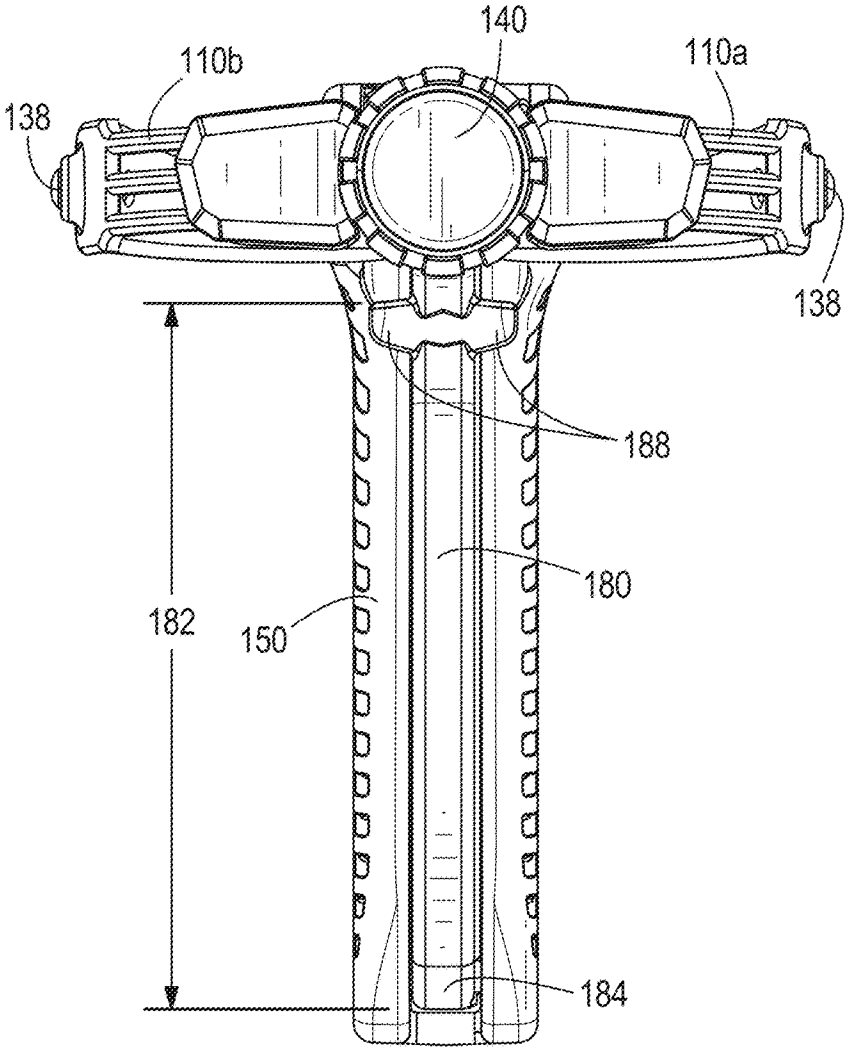
FIG. 3A is a front elevation view of the container holder of FIG. 1.

The strap 110 is preferably coupled to and extends between the two arm free ends 128, such as by rivets 138 extending through the strap 110, one rivet 138 extending through each of the mounting apertures 126 on the arms 122. The strap 110 may be a single unitary piece, such as an elastic rubber, which can be stretched to vary the size of the container through-hole 116. More preferably, the strap 110 includes an adjustment mechanism 140 to enable the container through-hole 116 to be adjusted and maintained. That is, while other strap adjustment mechanisms are envisioned, such as continuously adjustable ratchet straps, ratcheting strap with anti-rotation buckle or cam, a preferred adjustment mechanism 140 includes a rotational pinion knob 142 which, when turned (e.g., with a single human hand) in a first (e.g., clockwise) direction, causes a first rack strap portion 110*a* and a second rack strap portion 110*b* to move into or further along an overlapping direction 146*a* (see FIG. 2) so as to cause an effective diameter 145 of the container through-hole 116 to decrease (preferred effective diameters being 2.5 inches to 4.5 inches, with 2.625 to about 4 inches being most preferred). When the pinion knob 142 is turned in an opposite direction (e.g., counter-clockwise), it causes the first rack strap portion 110*a* and the second rack strap portion 110*b* to separate or cause less overlap in a diameter increasing direction 146*b*. This type of adjustment mechanism is known (though not previously used on beverage container mounts) and similar in design and function to that of a headgear assembly that resides inside of many hard-hats and welding helmets, for example, that allows the user to manually adjust the internal headgear to effectively allow the hard-hat or welding helmet to fit properly. An example of such rack strap and pinion knob adjustment mechanism is described in U.S. Pat. No. 7,043,772, to Bielefeld, et al., the entirety of which is incorporated herein by reference in its entirety.

The first rack strap portion 110*a* and second rack strap portion 110*b* may be constructed out of a relatively thin (1/16th inch thick, for example) flexible plastic material that may be approximately ½ to 1 inch wide and approximately 6-8 inches in length combined. The operative adjustment mechanism including the cooperation of the pinion knob 142 and the rack strap portions 110*a,b* may be shielded, such as with a shroud 144, so as to maintain cleanliness and/or assist in preventing accidental injury. This arrangement allows one to then manually turn/rotate the pinion knob 142 either clockwise or counter-clockwise. Rotation of the pinion knob 142 in a clockwise direction will cause the rack strap portions 110*a,b* to move towards and/or overlapping each other at least substantially simultaneously. Conversely, rotation of the pinion knob 142 in a counter-clockwise direction will cause the rack strap portions 110*a,b* to move away from and/or overlap each other less at least substantially simultaneously. Thus, by simply rotating the pinion knob 42 clockwise or counter-clockwise will change the effective diameter 145 of the container through-hole 116 from larger to smaller or from smaller to larger, respectively.

The handle 150 extends along a longitudinal length 152 from a bottom end 154 to a top end 156. A top portion 156*a* of the handle 150 is formed as a gooseneck 158, including a medial mounting slot 160 to receive at least a portion of the yoke neck 120 of the ring 110. The medial mounting slot 160 may extend into and along a majority of the longitudinal length 152 of the handle 150, such that the handle 150 has a substantially U-shaped cross-section taken perpendicular to the length 152. Within the medial mounting slot 160, in the gooseneck 158, is a second ratchet surface 162 including at least one tooth, but preferably has a plurality of teeth 164, configured to engage the first ratchet surface 132 provided on the ring neck 120. Also provided, such as on the top end 156 of the handle 150, is a stop lip 166, configured to contact the rotational limit surface 136 on the ring 110 to impede rotation of the ring 110 relative to the handle 150 at a predetermined angle (e.g., approximately ninety degrees with respect to the longitudinal length 152 of the handle 150, as described below). Through the gooseneck 158 a handle mounting aperture 168 is formed along an axis that is at least substantially perpendicular skew to the handle longitudinal length 152.

The ring neck 120 is supported by the handle 150, such as by being rotatably coupled thereto. It is to be understood that the ring 110 and handle 150 may be fixedly coupled, such as by being glued or otherwise fixedly fastened, or even formed from a unitary piece of material (e.g., handle and ring or yoke formed as a single piece), but rotatable coupling between the ring 110 and handle 150 is preferred so as to allow relative positioning that enhances storage capabilities, such as easier storage in a tackle box, purse, vehicle glove compartment, clothing pocket, etc. To rotatably couple the ring 110 to the handle 150, the bearing aperture 124 is aligned at least substantially coaxially with the handle mounting aperture 168 by inserting the neck 120 into the medial mounting slot 160, and placing a ring bias member (e.g., a helical spring) 170 between the neck 120 and a side of the mounting slot 160. The neck 120 has a width 120*a* that is narrower than the mounting slot 160, thus providing a mounting variance 160*a* that is greater than the width of the interface of the teeth 132,162, such that the neck 120 may be inserted into the mounting slot 160 freely (i.e., without contact with the handle 150). The bias member 170 forces the first ratchet surface 132 against the second ratchet surface 162, thereby allowing the teeth 134,164 to mate and impede rotation of the ring 110 with respect to the handle 150.

Figure 4A:
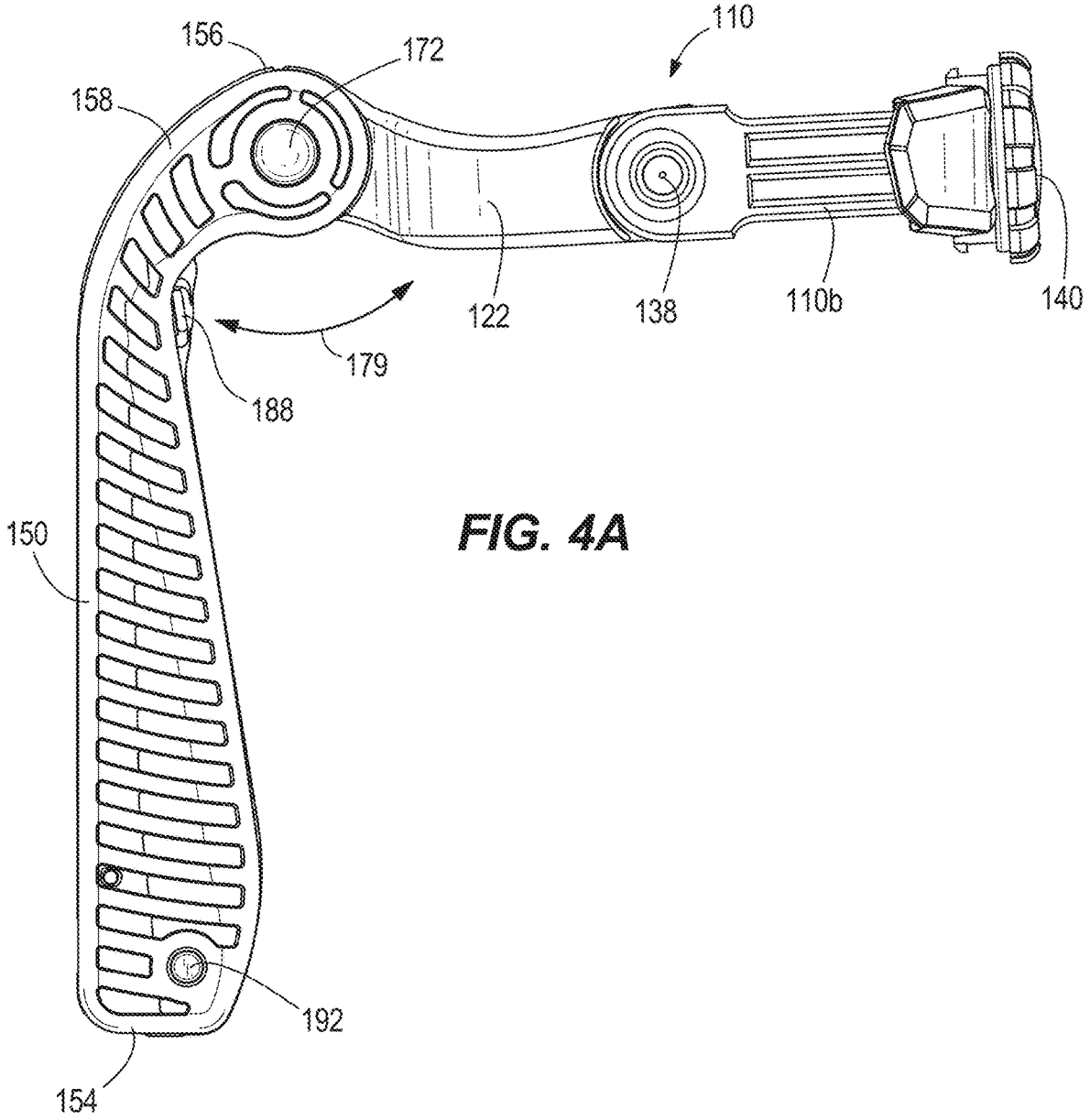
FIG. 4A is a left side elevation view of the container holder of FIG. 1.
Figure 4B:
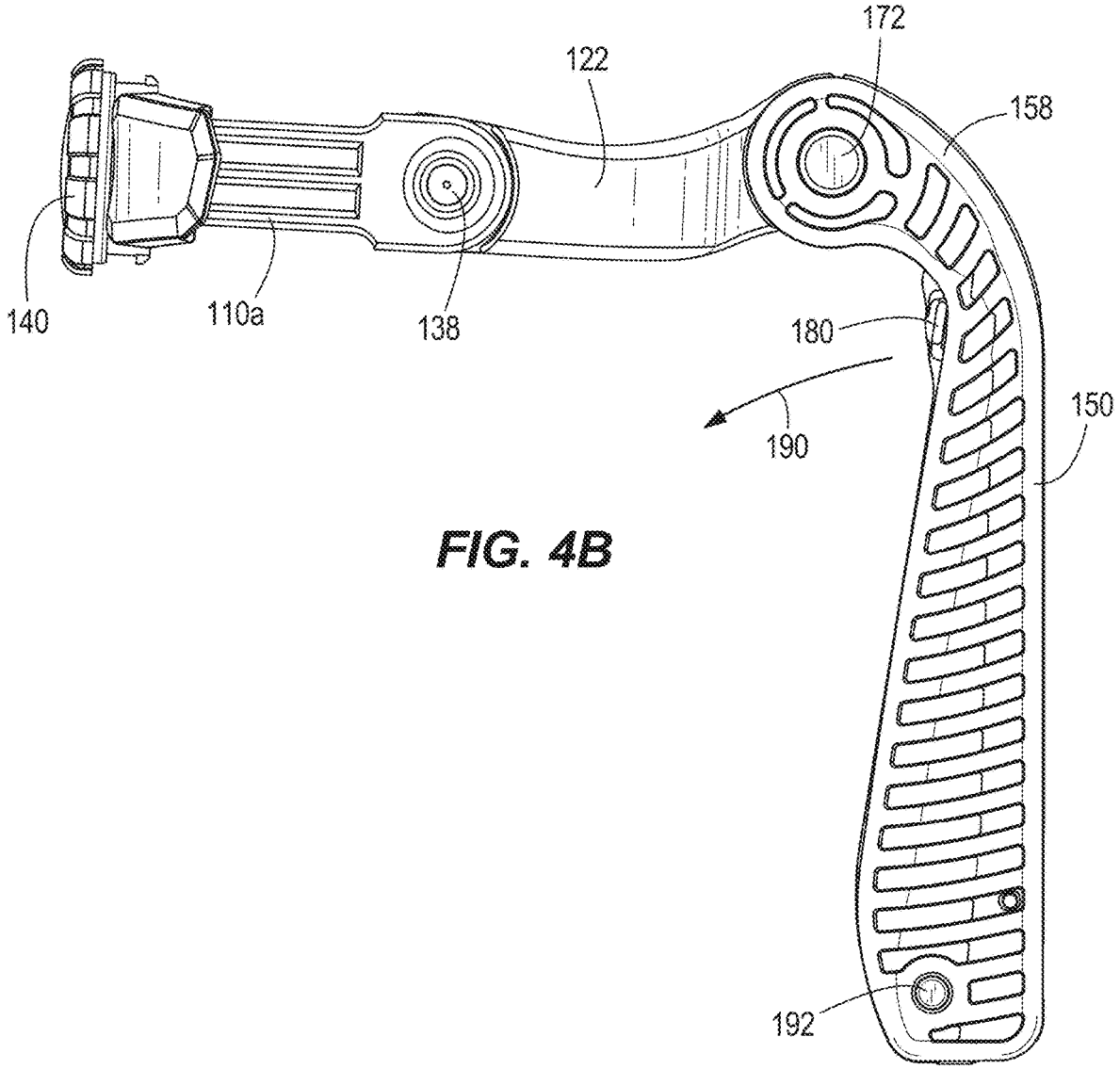
FIG. 4B is a right side elevation view of the container holder of FIG. 1.
Figure 5:
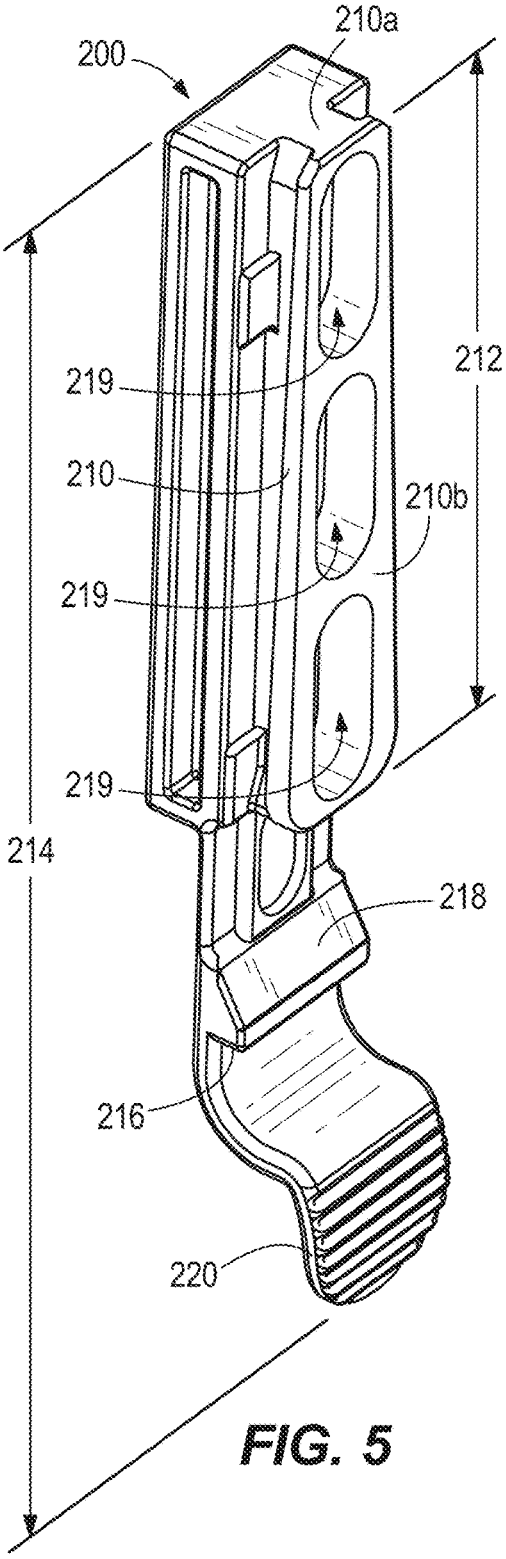
FIG. 5 is a perspective view of the mounting clip of FIG. 1.
Figure 6:
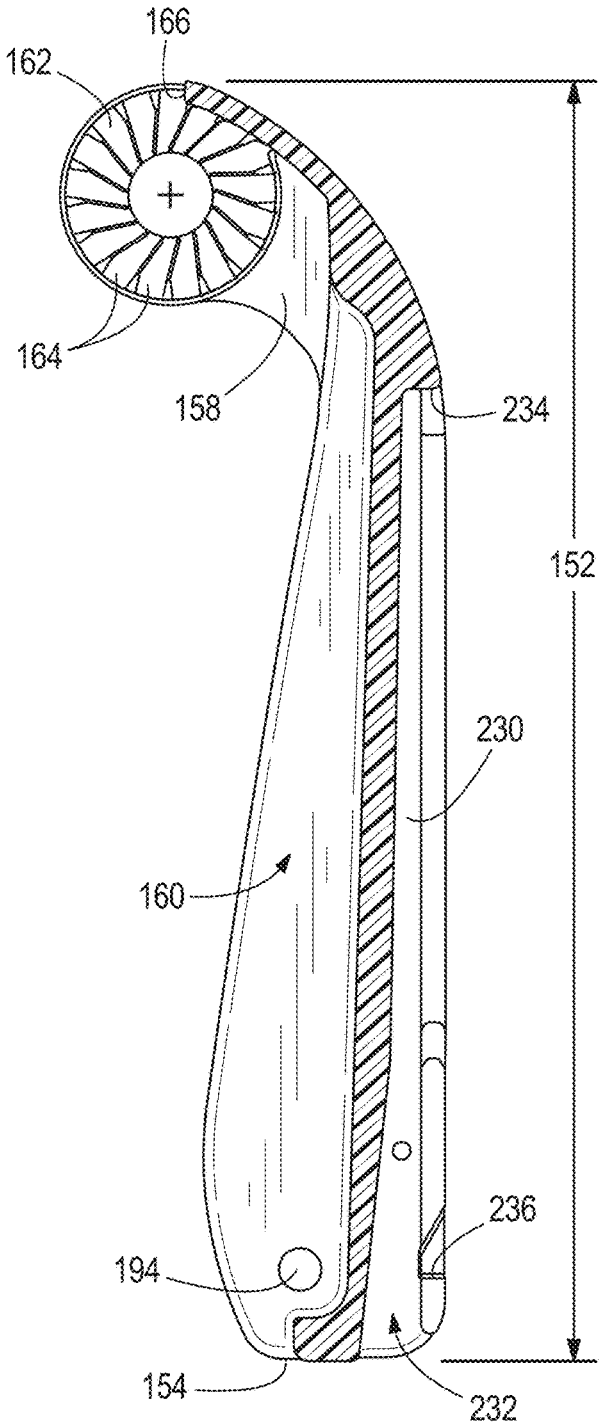
FIG. 6 is a partial cross-section view taken along line 6-6 of FIG. 1.

A pivot pin 172 can be inserted through the handle mounting aperture 168, past or through the bias member 170, and through the bearing aperture 124, preferably longitudinally protruding from an outer surface of the handle 150. The pivot pin 172 is preferably prevented from moving longitudinally by a retention clip 174 cooperating with and seated in a retention slot 176 preferably formed circumferentially about the pivot pin 172 at a predetermined longitudinal location. In this arrangement, external applied pressure (e.g., by a human finger or thumb) in a longitudinal direction 178 may overcome the compression force of the bias member 170, thus moving the neck into the variance space 160*a*, disengaging the teeth 134,164, and allowing the ring 110 to rotate in a partially circular travel path 179 (see FIG. 4*a*) with respect to the handle 150. Where multiple teeth 134,164 are provided on each ratchet surface 132,162 (thus allowing multiple discrete rotational positions of the ring 110), the external longitudinal force may be released to allow the teeth 134,164 to re-engage and thereby position the ring 110 at a desired angle with respect to the handle longitudinal length 152. The ring 110 is thus rotatable from a first position, such as at least substantially collapsed against the handle 150 (i.e., the container axis 118 being substantially perpendicular to the handle longitudinal length 152) to at least a second position, such as positioning the outermost portion of the ring (e.g., pinion knob 142) at a greater distance from the handle bottom end 154 than when the ring 110 is in the first position (e.g., the container axis 118 being substantially parallel to the handle longitudinal length 152). A plurality of additional rotational positions are envisioned through the use of multiple teeth 134,164 on the mating ratchet surfaces 132,162. In this way, predetermined adjustment angles may be defined, such as every 5, 10, 15, 30, or 45 degrees of rotation, or other desirable angle. Although disclosed as a pivot pin 172 and bias member 170, other mounting arrangements are contemplated, such as by using a conventional threaded bolt to perform the function of the pivot pin 172 and a nut to secure the ring 110 at a desired rotational position.

Optionally disposed preferably substantially within the handle 150 (e.g., within the medial mounting slot 160 or separate slot spaced from the medial slot 160) is a container support lever 180. The container support lever 180 extends along a support lever length 182 from a mounting end 184, which is rotatably supported within the handle 150, to a free end 186 including activation tabs 188. The container support lever 180 is movable from a first, stored, position (i.e., lever 180 extending substantially along the direction of the handle longitudinal length 152, and preferably a majority of the lever 180 is received within the handle 150) to an extended position (i.e., lever 180 extending substantially perpendicular to the direction of the handle longitudinal length 152 and/or the container axis 118). The activation tabs 188 may be grasped to rotate the lever 180 from the first position to the second position in a rotational direction 190 on or about a bearing pin 192 secured through a lever bearing aperture 194 formed through the handle 150 in a bottom end portion.

In the extended position, the support lever 180 assists in supporting a fluid container, and is especially useful in connection with non-tapered (e.g., substantially cylindrical) containers and/or containers about which it may not be desirable to secure the ring 110 to, such as by use of the adjustment mechanism 140. That is, there may be containers that have a tendency because of their shape to slip through the ring 110 but may be supported by the support lever 180, or there may be situations in which it may be desirable to loosen the ring 110 about a container, yet continue to support the container with the embodiment 100. A preferred support lever length 182 is equal to or greater than one-half of the effective diameter 145 of the container through-hole 116, and may extend across substantially the entire effective diameter 145 of the container through-hole 116 (or extend as far as necessary) so as to provide a support surface to prevent slippage of a container completely through the container through-hole 116.

Turning now to FIGS. 1, 3B, 5, and 6, some optional mounting structure can be seen. A preferred mounting structure comprises a rail 210 (such as the T-rail provided on a receiver clip 200) and a slot 230. While shown as a rail on the receiver clip 200 and a slot 230 provided on a rear surface of the handle 150, it is to be understood that this type of mating structure could be swapped (rail or male mounting structure on handle 150 and slot or female mounting structure on receiver 200). The rail 210 extends along a rail length 212 from a free rail end 210*a* along a longitudinal length 214 of the receiver clip 200 towards a clip surface 216 formed on a distal edge of a wedge clip 218. A clip release lever 220 is positioned on the opposite side of the wedge clip 218 from the T-rail 210. Provided through the T-rail 210 or supporting structure are preferably a plurality of stepped mounting holes or slots 219. The stepped nature of the holes or slots 219 allows a fastener (e.g., screw, bolt, etc.) to be received therethrough and the head of such fastener to be disposed within the slot 219 so as to maintain an exposed rail surface 210*b* that is relatively free from obstruction, thereby allowing longitudinal movement of the rail 210 within and along the slot 230. The holes or slots 219 may allow for some predetermined mounting variability or holes may be provided at relatively fixed, standard predetermined locations, such as to mate with standard substrate mounting structures (e.g., a bicycle water bottle mounting bolt pattern on a bicycle frame).

A mating female T-slot 230 is preferably formed in the handle 150, such as on a surface opposite the medial mounting slot 160. The T-slot 230 extends from an open end 232 to a terminus 234. Formed as a portion of the slot 230 (or along the edges thereof) are clip receiver slots 236 configured to receive and retain the wedge clip 218 provided on the receiver clip 200. Alternatively or additionally, mounting holes 229 may be provided through the handle 150, such as apertures formed at least substantially perpendicular to the handle longitudinal length 152. In this way, the handle 150 may be relatively permanently secured to a substrate without the need of a receiver clip 200. Other variations of the receiver clip 200 are also contemplated, such as a bar mount option, which may include mating U-shaped mounting structure to secure a receiver clip 200 to a tubular structure, such as a bicycle handlebar, motorcycle handlebar, or gunwale rails of a boat.

The cooperation of the T-rail 210 and T-slot 230 should be evident from the above description and associated figures. However, to use an embodiment 100 of a fluid container holder with a receiver clip 200, the receiver clip 200 may first be secured to a substrate, such as by being screwed or adhered to a support structure such as a panel, which may be a vehicle panel such as a dashboard of a motor vehicle or a gunwale of a boat (or vertical or near vertical structure near the gunwale). Alternatively, the receiver clip 200 could be adhered to a substrate. The receiver clip 200 should be mounted such that the rail length 212 is extending as close to vertical as possible, the free rail end 210*a* extending upward. The T-slot 230 is then mated with the T-rail 210 by inserting the rail free end 210*a* into the open end 232 of the slot 230 and sliding the handle 150 along the rail 210 until the slot terminus 234 contacts the rail free end 210*a* and/or the wedge clip 218 is received within the clip receiver slots 236. The relative translation of the slot 230 with respect to the rail 210 or vice versa is thus impeded by the containment of the wedge clip 218 within the clip receiver slots 236, in a first direction, and/or the abutment of the rail free end 210*a* and the slot terminus 234, in a second direction. Accordingly, it will be understood that the mounting structure may be reversed, not only male/female but also vertically top/bottom, and functionality will be maintained. Multiple receiver clips 200 may be secured to a vehicle so as to provide a plurality of fluid container holder mounting locations.

The foregoing is considered as illustrative only of the principles of the invention. Furthermore, since numerous modifications and changes will readily occur to those skilled in the art, it is not desired to limit the invention to the exact construction and operation shown and described. For instance, while terms like "vertical" and "horizontal" are used throughout, the terms are intended for general reference. Though technically such terms may include precise vertical and horizontal directionality, such precision is not required to fall within the scope of the description. While the preferred embodiment has been described, the details may be changed without departing from the invention, which is defined by the claims.

We claim:

1. A device comprising:

a handle having a longitudinal length;

a ring configured to receive and support a fluid container in a direction that is closer to parallel to the handle longitudinal length than to orthogonal to the handle longitudinal length, the ring comprising a neck extending into a portion of the handle, the neck comprising a first ratchet surface and the portion of the handle comprising a second ratchet surface mateable with the first ratchet surface; and a neck bias spring applying outward compressed force between the neck and the handle to force the first ratchet surface against the second ratches surface, wherein the ring is rotatably coupled to the handle and movable from a first static position to a second static position, the first static position being substantially parallel to the longitudinal length of the handle and the second static position being between the first static position and an angle of about 90 degrees from the first static position; and wherein the portion of the handle comprises a gooseneck.

2. A device according to claim 1, wherein the ring is selectively rotatable about an axis extending along a direction that is perpendicular skew to the longitudinal length of the handle.

3. A device according to claim 1, wherein the ring comprises a strap coupled to a yoke.

4. A device according to claim 3, wherein the yoke comprises a pair of arms extending from a neck, each arm extending to a free end.

5. A device according to claim 4, wherein the strap extends between two strap ends, each strap end being secured to one of the arm free ends.

6. A device according to claim 5, wherein the strap ends are secured with rivets.

7. A device according to claim 3, wherein the strap is adjustable in length.

8. A device according to claim 7, wherein the strap is adjustable to a plurality of fixed lengths, thereby changing an effective diameter of the ring.

9. A device according to claim 8, wherein the effective diameter is between 2.5 and 4.5 inches.

10. A device according to claim 9, wherein the effective diameter is between 2.625 inches and 4 inches.

11. A device according to claim 1, further comprising:

a mounting slot formed along a rear side of the handle, the mounting slot extending from an open end to a terminus.

12. A device comprising:

a handle having a longitudinal length;

a ring configured to receive and support a fluid container in a direction that is closer to parallel to the handle longitudinal length than to orthogonal to the handle longitudinal length;

a medial slot formed along a front surface of the handle; and a support lever extending along a lever length from a first end rotatably supported by the handle to a free end, wherein the support lever is rotatably coupled to the handle and movable from a first static position to a second static position, the first static position being substantially parallel to the longitudinal length of the handle and the second static position being between the first static position and an angle of about 90 degrees from the first static position, and wherein the ring is at least one of (a) rotatably coupled to the handle and movable from a first static position to a second static position, the first static position being substantially parallel to the longitudinal length of the handle and the second static position being between the first static position and an angle of about 90 degrees from the first static position; and (b) adjustable in diameter.

* * * * *